US007758477B2

(12) United States Patent
Prenatt

(10) Patent No.: US 7,758,477 B2
(45) Date of Patent: Jul. 20, 2010

(54) EXERCISE DEVICE

(76) Inventor: Jerry Prenatt, 17259 Shreve Run Rd., Pleasantville, PA (US) 16341

( * ) Notice: Subject to any disclaimer, the term of this patent is extended or adjusted under 35 U.S.C. 154(b) by 0 days.

(21) Appl. No.: 11/448,749

(22) Filed: Jun. 8, 2006

(65) Prior Publication Data

US 2007/0287600 A1 Dec. 13, 2007

(51) Int. Cl.
*A63B 21/072* (2006.01)
*A63B 21/06* (2006.01)

(52) U.S. Cl. ..... 482/93; 482/41; 482/106; 482/141; 220/772; 215/379; 215/396

(58) Field of Classification Search ..... 482/38, 482/93, 97, 106, 108, 111, 126, 87, 88, 89, 482/90, 25, 107, 109, 41, 92, 141; 29/254; 173/90; D9/527; 220/768, 770, 771, 772, 220/916; 215/379, 396
See application file for complete search history.

(56) References Cited

U.S. PATENT DOCUMENTS 1,552,073 A 9/1925 Mansfeldt
D167,991 S * 10/1952 Mack ..... D23/211.2
3,297,195 A * 1/1967 Hidding ..... 220/768
3,712,389 A * 1/1973 Smoak ..... 173/126
3,756,592 A 9/1973 Johnson
4,199,140 A * 4/1980 Ferretti ..... 482/106
4,333,645 A * 6/1982 Wu ..... 482/112
4,350,192 A * 9/1982 Dent ..... 144/195.5
D282,957 S * 3/1986 Carlson ..... D23/212
4,575,074 A 3/1986 Damratoski
4,591,150 A * 5/1986 Mosher ..... 482/125
4,618,143 A * 10/1986 Twardosz ..... 482/106
4,629,184 A * 12/1986 Selkee ..... 482/106
4,658,975 A * 4/1987 Cone ..... 215/385
4,681,171 A * 7/1987 Kee et al. ..... 173/90
4,690,399 A * 9/1987 Hayashi ..... 482/108
4,720,098 A 1/1988 Gordon
4,768,780 A * 9/1988 Hayes ..... 482/108
4,773,640 A 9/1988 Kolbel et al.
4,858,917 A * 8/1989 Montgomery ..... 482/106
4,863,158 A * 9/1989 Tassone ..... 482/140
4,872,667 A * 10/1989 Favot ..... 482/106
4,903,854 A * 2/1990 Schiemann ..... 220/772
4,969,571 A * 11/1990 Bartz ..... 220/771
4,986,535 A * 1/1991 Hull et al. ..... 482/93
4,986,536 A * 1/1991 Zane ..... 482/106
5,029,849 A 7/1991 Nurkowski
5,076,578 A * 12/1991 Askonen ..... 482/139
5,108,016 A * 4/1992 Waring ..... 222/468
5,152,523 A * 10/1992 Keen ..... 482/93

(Continued)

*Primary Examiner*—Loan H Thanh
*Assistant Examiner*—Daniel F Roland
(74) *Attorney, Agent, or Firm*—Oliff & Berridge, PLC

(57) ABSTRACT

An exercise device includes an elongate body, at least one first handle attached to an outer side surface of the elongate body, and at least one second handle attached to an end of the elongate body. The at least one first handle is arranged such that when the elongate body is lifted by the at least one first handle, the elongate body is substantially horizontal. The at least one second handle is arranged such that when the elongate body is lifted by the at least one second handle, the elongate body is substantially vertical. The first and second handles enable a variety of different exercises to be performed using the exercise device.

19 Claims, 4 Drawing Sheets

U.S. PATENT DOCUMENTS 5,177,850 A * 1/1993 Hull et al. ..... 29/254
5,207,338 A * 5/1993 Sandhu ..... 215/11.1
5,312,308 A * 5/1994 Hamilton et al. ..... 482/44
5,328,431 A * 7/1994 Winslow ..... 482/106
5,329,685 A * 7/1994 Gillespie ..... 29/254
5,393,284 A 2/1995 Wesley
5,393,285 A * 2/1995 Fischer et al. ..... 482/108
5,398,773 A * 3/1995 Baker ..... 173/90
D358,330 S * 5/1995 Kahl ..... D23/211.1
5,417,628 A * 5/1995 Vanderbleek ..... 482/40
5,464,379 A * 11/1995 Zarecky ..... 482/108
5,580,343 A * 12/1996 Cafiero ..... 482/139
5,716,305 A 2/1998 Selsam
5,735,779 A * 4/1998 Lay ..... 482/93
5,735,780 A * 4/1998 Fazio et al. ..... 482/112
5,820,531 A * 10/1998 Choi ..... 482/93
6,035,946 A * 3/2000 Studley et al. ..... 173/90
D422,654 S 4/2000 Chen
6,048,294 A * 4/2000 Formanek ..... 482/142
D425,151 S * 5/2000 Landfair ..... D21/681
6,071,218 A * 6/2000 Tepperberg ..... 482/121
D428,575 S * 7/2000 Forlano et al. ..... D9/434
6,129,650 A * 10/2000 Wedge, Jr. ..... 482/139
D433,635 S * 11/2000 Chrisco et al. ..... D9/527
6,224,519 B1 * 5/2001 Doolittle ..... 482/98
D449,863 S * 10/2001 Kinde ..... D21/682
6,312,364 B1 * 11/2001 Selsam ..... 482/93
6,390,959 B1 * 5/2002 Tornabene et al. ..... 482/126
D484,561 S 12/2003 Singleton
6,730,004 B2 5/2004 Selsam
D506,137 S * 6/2005 Durivage ..... D9/527
6,926,747 B2 * 8/2005 Udwin ..... 48/126
6,981,933 B2 1/2006 Scafidel
D520,366 S * 5/2006 Fonnesbeck ..... D9/524
7,056,268 B2 * 6/2006 Emick ..... 482/106
7,063,648 B1 * 6/2006 Brigham ..... 482/83
D526,203 S * 8/2006 Mishra ..... D9/527
7,090,625 B2 * 8/2006 Chermack ..... 482/108
7,094,186 B2 * 8/2006 Diakonov et al. ..... 482/104
7,097,601 B1 * 8/2006 Ronnow ..... 482/106
7,182,214 B2 * 2/2007 Darr et al. ..... 215/398
D544,554 S * 6/2007 Brun ..... D21/680
7,244,220 B2 * 7/2007 Carney ..... 482/106
2003/0130096 A1 * 7/2003 LaCroce ..... 482/106
2004/0067826 A1 * 4/2004 Elledge ..... 482/106
2004/0082445 A1 4/2004 Zabel
2004/0147380 A1 * 7/2004 Mattox ..... 482/139
2005/0065001 A1 * 3/2005 Su ..... 482/106
2005/0065002 A1 * 3/2005 Su ..... 482/106
2005/0075223 A1 * 4/2005 Wu ..... 482/126
2005/0187075 A1 8/2005 Bellamy
2005/0187079 A1 8/2005 Diakonov et al.
2005/0187086 A1 * 8/2005 Bull ..... 482/142
2005/0202942 A1 * 9/2005 De Lano ..... 482/107
2006/0116256 A1 * 6/2006 Carney ..... 482/106
2006/0151966 A1 * 7/2006 Murphy et al. ..... 280/47.26
2006/0160682 A1 * 7/2006 Maloy et al. ..... 482/126
2007/0099771 A1 * 5/2007 Fu ..... 482/83
2007/0181320 A1 * 8/2007 Mason ..... 173/90

* cited by examiner

EXERCISE DEVICE

BACKGROUND

This invention relates to an exercise device usable for strength training, endurance training, physical rehabilitation, or the like.

Weight lifting equipment has long been used for strength training, endurance training and physical rehabilitation. Traditional weight lifting equipment is in the form of "free weights," including barbells and the like on which weight disks are mounted, or "machine weights," in which stacks of weights slide on bars or guide tracks and are attached to various lifting bars and/or cables via which users lift the stacked weights through various lifts such as the bench press, military press, curls, leg presses, and so forth.

SUMMARY

Free weights and machine weights typically require a large amount of room to store and use. Machine weights often require an entire room to accommodate a single machine. Free weights usually require various types and lengths of bars, as well as the individual weight disks. Various specialized weightlifting devices have been introduced, but these typically enable only a relatively small number of different lifts to be performed.

This invention provides an exercise device including an elongate body, at least one first handle attached to an outer side surface of the elongate body, and at least one second handle attached to an end of the elongate body. The at least one first handle is arranged such that when the elongate body is lifted by the at least one first handle, the elongate body is substantially horizontal. The at least one second handle is arranged such that when the elongate body is lifted by the at least one second handle, the elongate body is substantially vertical.

The elongate body may include a hollow tubular member, and end plates that seal opposite ends of the hollow tubular member. A removable plug may be provided in a wall of the exercise device 10, such as in an end plate. Flowable material such as water or sand may be introduced into the hollow tubular member via the plug.

A wide variety of lifts may be performed using a single exercise device according to the invention.

These and other objects, advantages and salient features of the invention are described in or apparent from the following description of embodiments.

BRIEF DESCRIPTION OF THE DRAWINGS

Exemplary embodiments will be described with reference to the accompanying drawings, in which like numerals represent like parts, and wherein.

DETAILED DESCRIPTION OF EMBODIMENTS

Figure 1:
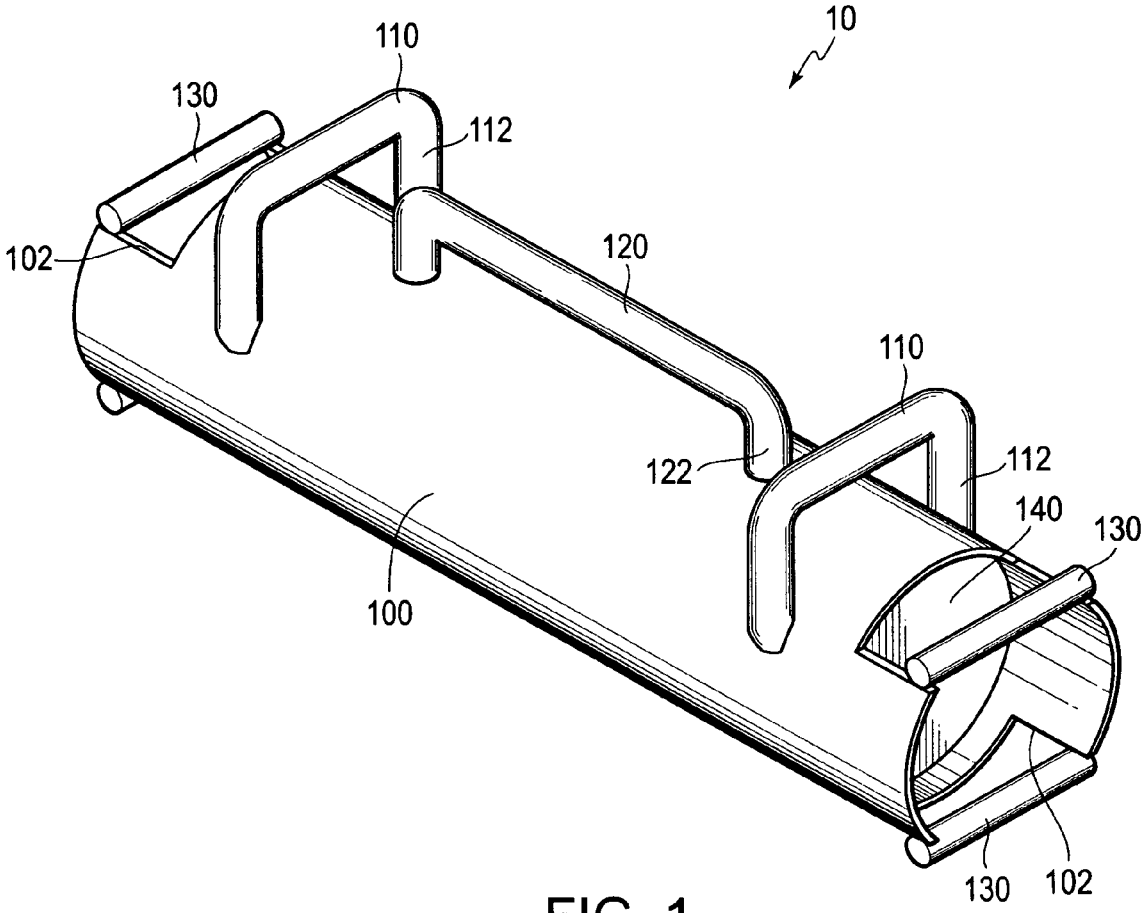
FIG. 1 is a perspective view of a first embodiment of an exercise device.

FIG. 1 is a perspective view of an exercise device 10 according an exemplary embodiment of this invention. The exercise device 10 includes an elongate body. As depicted in FIGS. 1 and 3-5, the elongate body may include a hollow tubular member 100, and end plates 140 that seal opposite ends of the hollow tubular member 100. In other embodiments, the elongate body may have a solid center; however, using the hollow tubular member 100 as the elongate body provides various advantages, as described in more detail below. The elongate body may be made of carbon steel, aluminum, stainless steel, or any other suitable material. Metal material such as carbon steel, aluminum or stainless steel is advantageous in terms of durability and strength of the exercise device 10. Hereafter, reference will be made to the hollow tubular member 100 as a specific example of an elongate body, but it will be understood that this is only one example of an elongate body, and that features such as the handles described below can also be used in connection with a solid elongate body.

The hollow tubular member 100 may have any desired width or diameter, and any desired length. For example, the nominal diameter of the hollow tubular member 100 may be 4 inches, 6 inches, 8 inches, 10 inches, 12 inches, 14 inches or 16 inches. The length of the hollow tubular member 100 may be 24 inches, 30 inches, 36 inches, 42 inches or 48 inches. A plurality of the exercise devices 10, each having a different size, may be provided as a set.

Figure 3:
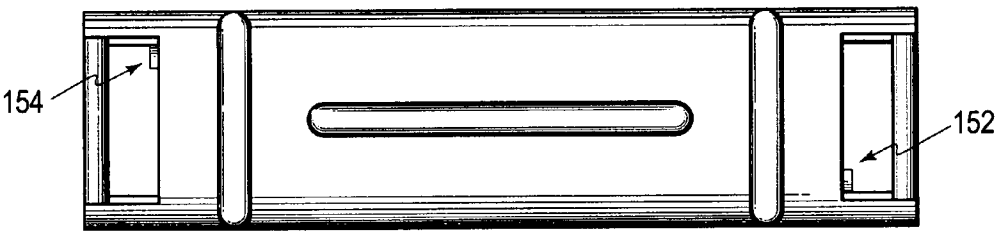
FIG. 3 is a plan view of the exercise device of FIG. 1.
Figure 2:
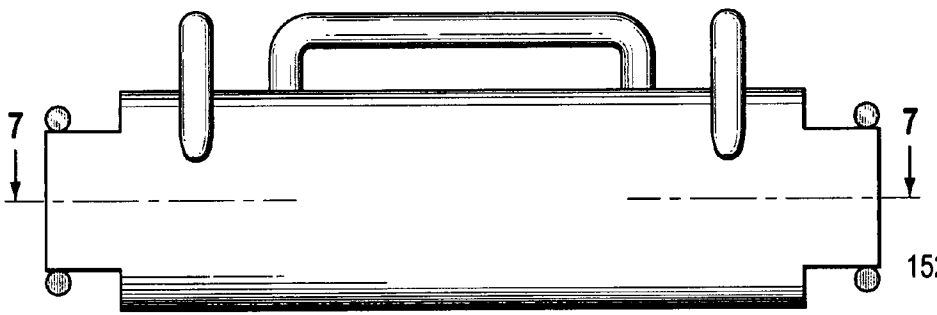
FIG. 2 is a front elevation view of the exercise device of FIG. 1.
Figure 6:
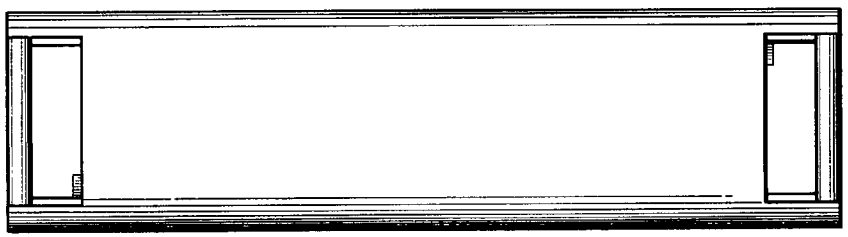
FIG. 6 is a bottom view of the exercise device of FIG. 1.
Figure 4:
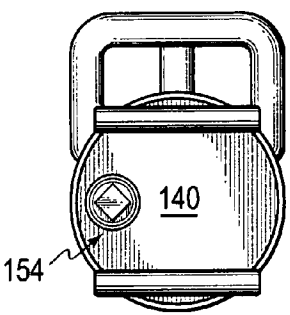
FIG. 4 is a left side elevation view of the exercise device of FIG. 1.
Figure 5:
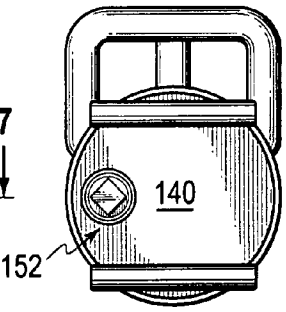
FIG. 5 is a right side elevation view of the exercise device of FIG. 1.

As depicted in, e.g., FIGS. 3 and 5, a removable plug 152 may be provided in one of the end plates 140. If desired, a similar plug 154 can also be provided in the other end plate 140 as well. The plugs 152 and 154 can be, for example, threaded plugs that thread into respective pipe fittings attached to the end plate 140. In the depicted embodiment, the plug 152 will be referred to as a fill plug, and the plug 154 will be referred to as a drain plug.

The plugs 152 and 154 can be removed to allow admission of flowable material into the hollow tubular member 100 to increase the weight of the exercise device 10, and/or to allow removal of the flowable material The flowable material may be, for example, water, sand or the like.

A plurality of handles are attached to the hollow tubular member 100. The handles may include handles 110, 120 and/or 130, in any desired combination. When necessary or appropriate, the handles are attached to the hollow tubular member 100 via legs. For example, as shown in FIG. 1, the handles 110 are attached to an outer periphery of the hollow tubular member 100 via leg portions 112, and the handles 120 are attached to an outer periphery of the hollow tubular member 100 via leg portions 122. When the hollow tubular member 100 and the handles 110, 120 and/or 130 are made of metal, the handles 110, 120 and/or 130 may be attached to the hollow tubular member 100 by welding.

As shown best in FIG. 3, the handles 110 extend in a direction crossing the longitudinal axis of the hollow tubular member 100. In the depicted embodiments, the handles 110 extend in a direction substantially perpendicular to the longitudinal axis of the hollow tubular member 100, but in other embodiments the handles 110 may extend in a different direction crossing the longitudinal axis of the hollow tubular member 100. For example, the handles 110 may extend at an angle of from about 60° to about 80° with respect to the longitudinal axis of the hollow tubular member 100.

The handle 120 extends along a longitudinal axis of the hollow tubular member 100. In the depicted embodiments, the handle 120 extends parallel to the longitudinal axis of the hollow tubular member 100, but in other embodiments the handle 120 may have one or more portions that are not parallel to the longitudinal axis of the hollow tubular member 100. For example, rather than being straight, the handle 120 may have a W-shape, S-shape or the like, as seen in plan view. A handle of any of these other shapes is also considered to extend along the longitudinal axis of the hollow tubular member 100.

The handles 110 are arranged such that, when a user grasps the handles 110 and lifts the hollow tubular member 100, the hollow tubular member 100 is substantially horizontal. Similarly, the handle 120 is arranged such that, when a user grasps the handle 120 at positions equidistant from the longitudinal center of the hollow tubular member 100 and lifts the hollow tubular member 100, the hollow tubular member 100 is substantially horizontal.

The handles 130 are attached to ends of the hollow tubular member 100. In the depicted embodiments, cutouts 102 are formed in a peripheral wall of the hollow tubular member 100 at ends of the hollow tubular member 100, and the handles 130 span the cutouts 102. In other embodiments, the handles 130 may have leg portions like the leg portions 112 and 122 described above. In this case, the cutouts 102 may not be needed, because the leg portions of the handles 130 could be attached to the ends of the hollow tubular member 100 or other elongate body, and be easily accessible for gripping. In the depicted embodiments, the handles 130 are parallel to each other, but in other embodiments the handles 130 may be positioned at an angle relative to each other. When a user grasps the handles 130 at one end of the hollow tubular member 100 and lifts the exercise device 10, the hollow tubular member 100 is substantially vertical.

As mentioned above, flowable material such as water, sand or the like may be introduced into the hollow tubular member 100 via the removable plug 150. The hollow tubular member 100 may be completely filled, for maximum weight. Alternatively, the hollow tubular member 100 may be partially filled, to result in any desired weight between the empty weight and full weight of the exercise device 10. When the hollow tubular member 100 is filled partially, a "slosh effect" can be achieved by alternately lifting one end of the hollow tubular member 100 higher than the other end, causing the flowable material to shift from one end to the other inside the hollow tubular member 100. This can have the beneficial effect of exercising certain muscles or muscle groups that may otherwise be difficult to exercise.

Figure 7:
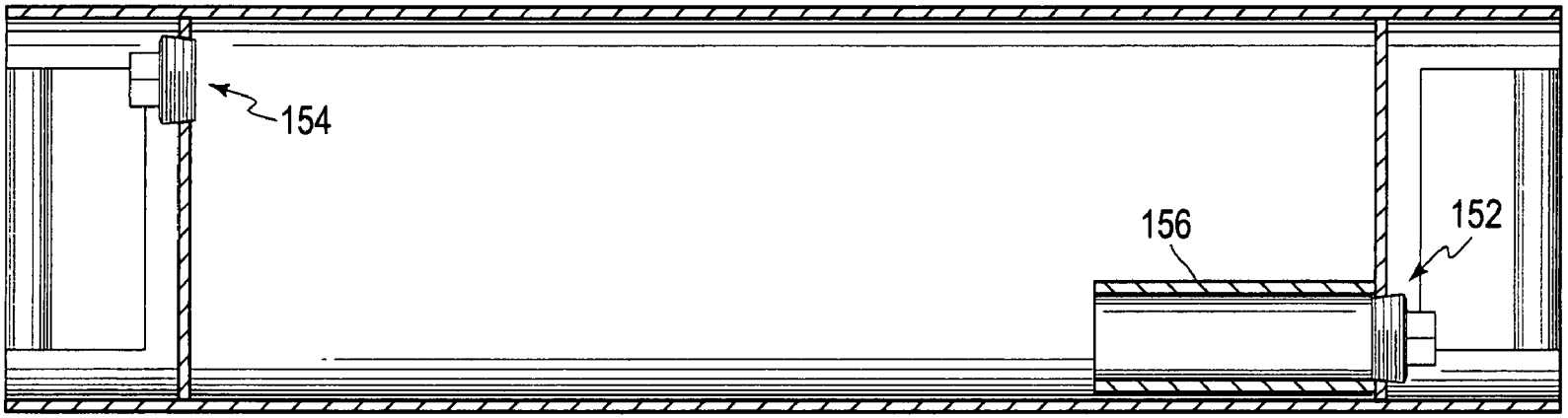
FIG. 7 is a cross-sectional view taken along line 7-7 of FIG. 2.

As shown in FIG. 7, to ensure that the hollow tubular member 100 is only partially filled, a tube 156 may be connected to one of the end plates 140, in communication with the fill hole that is stopped by the plug 152. The tube 156 may extend into the interior of the hollow tubular member, and may have a length of, for example, about 25% of the length of the hollow tubular member 100. When the hollow tubular member 100 is positioned with the fill hole facing upward, and flowable material is caused to flow into the hollow tubular member 100 the tube 156 restricts further entry of flowable material when the level of flowable material reaches the bottom of the tube. The tube 156 may be permanently attached to the end plate 140 by welding or any other suitable attachment method. Alternatively, the tube may be detachable, e.g., by being insertable through the fill hole from outside of the hollow tubular member 100, and then removable through the fill hole after entry of the flowable material. A plurality of such detachable fill tubes could be provided, each having a different length, for filling the hollow tubular member 100 to different levels.

Using the exercise device 10, a variety of different lifts can be performed for strength training, endurance training or physical rehabilitation. For example, the so-called "Olympic lifts" can be performed using the exercise device 10. The Olympic lifts include the categories of "clean and jerk" and "snatch." "Clean and jerk" lifts include the front squat, the hang jump shrug, the jump shrug, hang pulls, high pulls, hang cleans, the clean, the push press, and the split jerk. "Snatch" lifts include the hang snatch, the overhead squat, the press under, and the quick drop. Other lifts that may be performed include various types of curls. A list of exercises and/or lifts that may be performed using the exercise device 10 is given below. It will be understood that this is not an exhaustive list, and that other lifts or exercises may also be performed using the exercise device 10. In the list, "inside handles" refers to the handles 110, "outside handles" refers to the handles 130, and "middle handle" refers to the handle 120. "Barrels" refers to exercise devices 10. Those skilled in the art will understand how to perform the exercises, as they are well known.

Strength Exercises
Bench (Inside and Outside Handles)
Floor Press (Inside and Outside Handles)
Incline (Inside and Outside Handles)
Back Squat (Inside and Outside Handles)
Front Squat (Inside and Outside Handles)
Overhead Squat (Inside and Outside Handles)
One Leg Squat (Outside Handles)
Zercher One Leg Squat (No Handles Used)
Step Ups (Outside Handles)
Deadlift (Middle Handle)
Sumo Deadlift (Middle Handle)
Single Arm Deadlift (Middle Handle)
Unbalanced Deadlift (Middle Handle) (2 barrels of different weight)
Unbalanced Sumo Deadlift (Middle Handle) (2 barrels of different weight)
Zercher Squat (No Use of Handles)
Farmers Walk (Middle Handle)
Unbalanced Farmers Walk (Middle Handle) (2 barrels of different weight)
Romanian Deadlift (Middle Handle)
Bent Over Row (Middle Handle)
Single Arm Row from Push Up Position (2 barrels) (Middle Handle)
Weighted Isometric Crunch (Inside and Outside Handles)
Good Mornings (Outside Handles)
Woodchoppers (Outside Handles)
Hammer Curls (Outside Handles)
Strength/Power Exercises
Hang Snatch (Outside Handles)
Hang Split Snatch (Outside Handles)
Snatch From Floor (Outside Handles)
Split Snatch From Floor (Outside Handles)
Hang High Pulls (Middle Handle)
High Pulls From Floor (Middle Handle)
Hang Clean (Outside Handles)
Hang Split Clean (Outside Handles)
Clean From Floor (Outside Handles)
Split Clean From Floor (Outside Handles)
Front Jerk (Inside and Outside Handles)
Front Split Jerk (Inside and Outside Handles)
Behind the Head Split Jerk (Outside Handles)
Behind the Head Jerk (Outside Handles)
Push Press (Outside Handles)

Front Push Press (Outside and Inside Handles)

Barrel Swings (Middle Handle)

Strength/Power Combination Lifts

Hang Snatch to Overhead Squat (Outside Handle)

Snatch from Floor to Overhead Squat (Outside Handle)

Behind the Head Squat Jerk (Outside Handle)

Front Squat Jerk (Outside and Inside Handles)

Behind the Head Squat-Split Jerk (Outside Handles)

Front Squat-Split Jerk (Outside and Inside Handles)

Hang Split Snatch+One Leg Squat (Outside Handles)

Snatch from Floor+One Leg Squat (Outside Handles)

Hang Clean+Jerk (Outside Handles)

Hang Clean+Split Jerk (Outside Handles)

Clean from Floor+Jerk (Outside Handles)

Clean from Floor+Split Jerk (Outside Handles)

Behind the Head Squat+Jerk (Outside Handles)

Behind the Head Squat+Split Jerk (Outside Handles)

Hang Clean+Front Squat+Jerk (Inside and Outside Handles)

Hang Clean+Front Squat+Split Jerk (Inside and Outside Handles)

Clean from Floor+Front Squat+Jerk (Inside and Outside Handles)

Clean from Floor+Front Squat+Split Jerk (Inside and Outside Handles)

Hang Clean+Front Squat+Split Jerk+One Leg Squat (Outside Handles)

Figure 8:
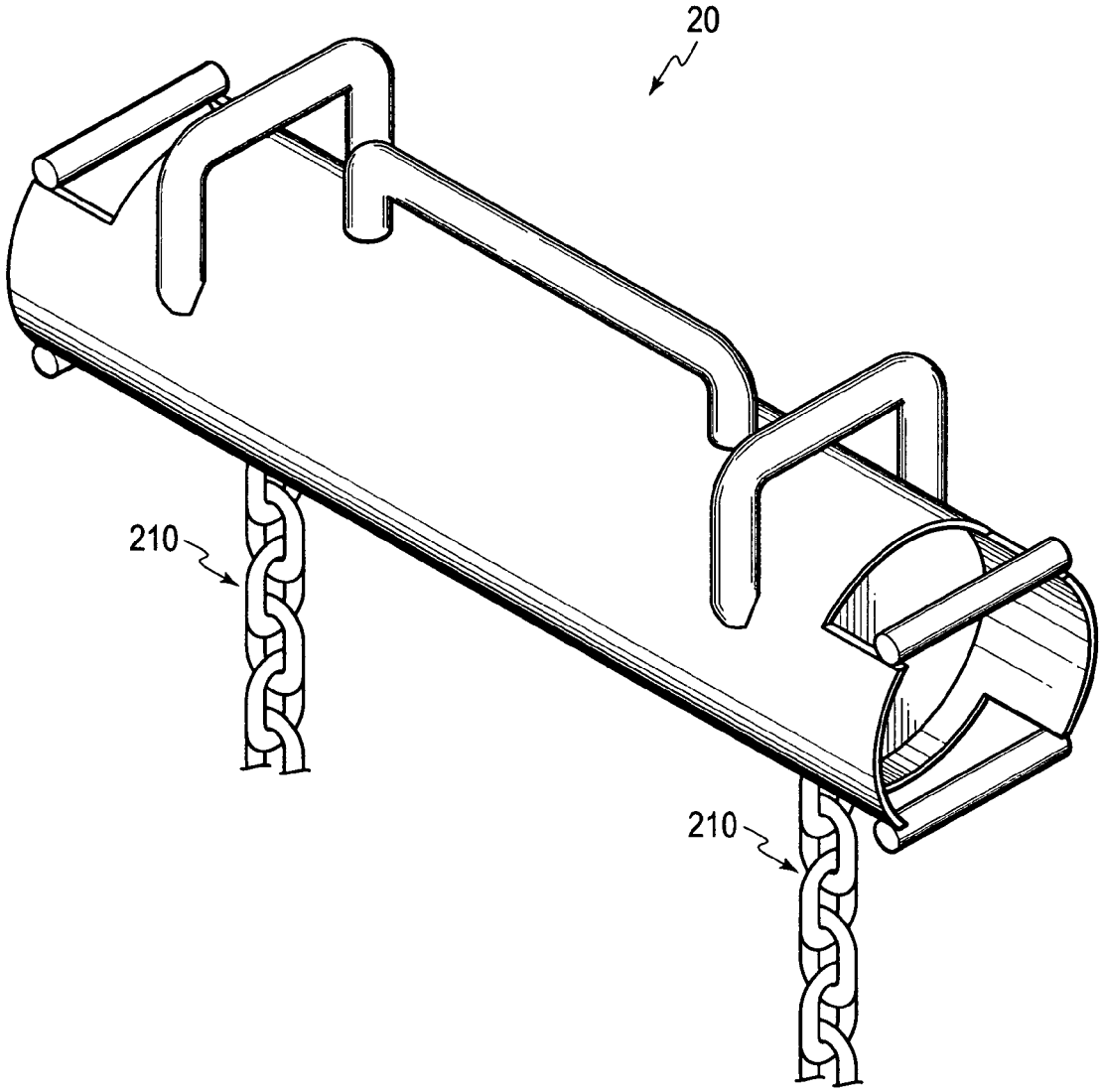
FIG. 8 is a perspective view of a second embodiment of an exercise device.

As shown in FIG. 8, an exercise device 20 according to another exemplary embodiment may include flexible weight devices attached to the exercise device 20. In this embodiment, the flexible weight devices are chains 210. The chains 210 may be made of, for example, ¼", ⅜", ½" or ⅝" diameter metal material. The chains 210 increase the weight of the exercise device 20. The chains 210 may be of any desired length, and any desired number of chains 210 may be attached to the exercise device 20. The chains 210 may be permanently attached, but preferably are releasably attached so that they may be attached or taken off at will to increase or decrease the overall weight of the exercise device. If the chains 210 are of sufficient length, such as about 5 feet or more, then when a user lowers the exercise device 10, a portion of the chains 210 rests on a support surface such as the floor. This gradually decreases the weight being supported by the user. Conversely, when the user raises the exercise device 10, the portion of the chains 210 that rested on the support surface is raised off of the support surface, thereby gradually increasing the weight supported by the user.

According to the exercise devices described above, a wide variety of different lifts may be performed using a single exercise device. The above-described embodiments are effective tools for effective muscular balance work, local muscular endurance work, preparation of the body to absorb shock, and improving flexibility. Exercises and lifts performed using the above-described exercise devices can help reduce the occurrence of osteoarthritis in joints, build tendon and ligament strength, and train athletes to cope with uncooperative and unbalanced loads. The exercise devices are effective in all realms of strength training (i.e., absolute strength, speed strength, explosive strength and muscular endurance).

While the invention has been described in conjunction with specific embodiments, these embodiments should be viewed as illustrative and not limiting. Various changes, substitutes, improvements or the like are possible within the spirit and scope of the invention.

What is claimed is:

1. An exercise device, comprising:

an elongate body comprising (i) a hollow tubular member, made of metal material, that has a peripheral wall and (ii) end plates that seal opposite ends of the hollow tubular member, a plurality of cutouts being formed in the peripheral wall at an end of the tubular member;

a plug in at least one of the end plates, the plug being removable to allow admission of flowable material into the hollow tubular member, and attachable to seal the flowable material inside the hollow tubular member;

at least one first handle attached to an outer side surface of the elongate body, the at least one first handle being arranged such that when the elongate body is lifted by the at least one first handle, the elongate body is substantially horizontal, wherein the at least one first handle comprises at least one of the group consisting of (i) two handles that extend in a direction crossing the longitudinal axis of the elongate body and (ii) a handle that extends in a direction parallel to the longitudinal axis of the elongate body; and two second handles attached to an end of the elongate body, each of the two second handles spanning a respective one of the cutouts, the two handles being arranged such that when the elongate body is lifted by the two second handles, the elongate body is substantially vertical, the at least one first handle being positioned non-symmetrically with respect to the two second handles.

2. The exercise device of claim 1, wherein the at least one first handle comprises a handle that extends along a longitudinal axis of the elongate body.

3. The exercise device of claim 1, wherein a plurality of additional cutouts are formed in the peripheral wall at an opposite end of the tubular member, further comprising two additional second handles attached to an opposite end of the elongate body, each additional second handle spanning a respective one of the additional cutouts.

4. The exercise device of claim 1, wherein each second handle extends in a direction substantially perpendicular to a longitudinal axis of the elongate body.

5. The exercise device of claim 1, wherein the two second handles extend parallel to each other.

6. The exercise device of claim 1, further comprising a tube in communication with a hole that is stopped by the plug, the tube extending into the hollow tubular member and having an end that opens to an interior of the hollow member.

7. The exercise device of claim 6, wherein a fixed end of the tube is permanently attached to one of the end plates.

8. The exercise device of claim 1, further comprising at least one flexible weight device attached to the elongate body.

9. The exercise device of claim 8, wherein the at least one flexible weight device comprises a chain.

10. The exercise device of claim 8, wherein the at least one flexible weight device is of sufficient length that when a user lowers the exercise device, a portion of the flexible weight device rests on a support surface, and when the user raises the exercise device, a portion of the flexible weight device that rested on the support surface is raised off of the support surface, thereby variably adjusting the weight supported by the user.

11. The exercise device of claim 1, wherein each cutout is formed in the peripheral wall at an end of the tubular member, and each second handle spans one of the cutouts.

12. The exercise device of claim 1, wherein the at least one first handle comprises two handles that each extend in a direction non-parallel to a longitudinal axis of the elongate body.

13. A method, comprising:

performing lifts for strength training, endurance training or physical rehabilitation using the exercise device of claim 1.

14. The exercise device of claim 1, wherein the at least one first handle comprises (i) a handle that extends along a longitudinal axis of the elongate body and (ii) two handles that each extend in a direction non-parallel to a longitudinal axis of the elongate body.

15. An exercise device, comprising:

an elongate body comprising (i) a hollow tubular member that has a peripheral wall and (ii) end plates that seal opposite ends of the hollow tubular member;

a plug in at least one of the end plates, the plug being removable to allow admission of flowable material into the hollow tubular member, and attachable to seal the flowable material inside the hollow tubular member;

at least one first handle attached to an outer side surface of the elongate body; and two second handles attached at a first longitudinal end of the elongate body, and two more second handles attached at a second longitudinal end of the elongate body, the at least one first handle being positioned non-symmetrically with respect to each of the second handles, the at least one first handle being arranged such that when the elongate body is lifted by the at least one first handle and allowed to hang freely, but not lifted by the two second handles, the elongate body is substantially horizontal, and the second handles being arranged such that when the elongate body is lifted by the two second handles at one longitudinal end of the elongate body and allowed to hang freely, but not lifted by the at least one first handle, the elongate body is substantially vertical.

16. The exercise device of claim 15, further comprising a tube in communication with a hole that is stopped by the plug, the tube extending into the hollow tubular member and having an end that opens to an interior of the hollow member.

17. The exercise device of claim 15, wherein the at least one first handle comprises two handles that each extend in a direction non-parallel to a longitudinal axis of the elongate body.

18. A method, comprising:

performing lifts for strength training, endurance training or physical rehabilitation using the exercise device of claim 15.

19. The exercise device of claim 15, wherein the hollow tubular member is made of metal material.

* * * * *